United States Patent [19]

Grushkin

[11] Patent Number: 4,681,829

[45] Date of Patent: Jul. 21, 1987

[54] SINGLE COMPONENT RED DEVELOPER COMPOSITIONS

[75] Inventor: Bernard Grushkin, Pittsford, N.Y.

[73] Assignee: Xerox Corporation, Stamford, Conn.

[21] Appl. No.: 902,720

[22] Filed: Sep. 2, 1986

[51] Int. Cl.[4] ..... G03G 9/08

[52] U.S. Cl. ..... 430/109; 430/110; 430/111

[58] Field of Search ..... 430/109, 110, 111

[56] References Cited

U.S. PATENT DOCUMENTS

| | | | |
|---|---|---|---|
| 3,652,438 | 3/1972 | Jones, Jr. | 204/181 |
| 3,781,208 | 12/1973 | Ueda et al. | 252/62.1 |
| 3,933,664 | 1/1976 | Nagashima et al. | 252/62.1 |
| 4,051,052 | 9/1977 | Ueda et al. | 252/62.1 |
| 4,145,299 | 3/1979 | Ford, Jr. et al. | 252/62.1 L |
| 4,258,116 | 3/1981 | Takasu et al. | 430/102 |
| 4,414,320 | 11/1983 | Santilli et al. | 430/106 |
| 4,431,721 | 2/1984 | Jost et al. | 430/37 |
| 4,443,527 | 4/1984 | Heikens et al. | 430/39 |
| 4,530,893 | 7/1985 | Maekawa et al. | 430/106 |
| 4,563,409 | 1/1986 | Suzuki et al. | 430/106 |

*Primary Examiner*—John L. Goodrow
*Attorney, Agent, or Firm*—E. O. Palazzo

[57] ABSTRACT

A positively charged single component toner composition comprised of resin particles, pigment particles selected from the group consisting of substituted perylenes and monoazo pigments, and a charge enhancing additive. Further, there can be added to the toner composition additive particles such as colloidal silica and low molecular weight waxes.

17 Claims, No Drawings

SINGLE COMPONENT RED DEVELOPER COMPOSITIONS

BACKGROUND OF THE INVENTION

This invention is generally directed to red developer compositions, and the use of these compositions in electrostatographic imaging systems. More specifically, the present invention is directed to positively charged single component red developer compositions comprised of resin particles, specific classes of red pigments, charge enhancing additives, and additive components. The aforementioned developer compositions are particularly useful in the electrostatographic imaging systems as illustrated in Hays U.S. Pat. No. 4,459,009, the disclosure of which is totally incorporated herein by reference.

Toner compositions with charge enhancing additives are generally known. Thus, for example, there is disclosed in U.S. Pat. No. 3,893,935 the use of certain quaternary ammonium compounds as charge control agents for electrostatic toner compositions. This patent teaches the incorporation of a specific quaternary ammonium compound into toner compositions for the purpose of obtaining particles exhibiting relatively high uniform and stable net toner charge when mixed with a suitable carrier vehicle. A similar teaching is disclosed in U.S. Pat. No. 4,079,014 with the exception that a different charge control additive is selected, namely, a diazo type material.

Further, there are described in U.S. Pat. No. 4,298,672 developer compositions containing as a charge enhancing additive an alkyl pyridinium compound including, for example, cetyl pyridinium chloride. Other patents disclosing toner compositions with charge control additives include U.S. Pat. Nos. 3,944,493; 4,007,293; and 4,394,430. Also, there are illustrated in U.S. Pat. No. 4,560,630, the disclosure of which is totally incorporated herein by reference, developer compositions with distearyl dimethyl ammonium methyl sulfate charge additives; and in U.S. Pat. No. 4,338,390, the disclosure of which is totally incorporated herein by reference, developers containing as charge enhancing additives various sulfate and sulfonates.

Also known are colored developer compositions, reference for example U.S. Pat. No. 4,562,135, which discloses positively charged toner compositions with chromophores. Further, illustated in copending application U.S. Ser. No. 764,024 are positively charged toner compositions with first and second resin particles, a charge enhancing additive, and pigments such as cyan, magenta, and yellow.

Moreover, there are described in U.S. Pat. No. 4,443,527 colored magnetically attractable toner powders without charge control additives containing a magnetic core, a masking layer enveloping the core and coloring agents, inclusive of Pigment Red 49, Pigment Red 49:1, and Pigment Red 49:2 present in/or on the masking layer. Other examples of coloring agents illustrated in the '527 patent include insoluble azo pigments such as toluidine red, naphthol red pigments, Pigment Red 17, Pigment Red 31, and perylene pigments, see column 4, beginning at line 16. Also, in U.S. Pat. No. 4,530,893 there is disclosed one component red colored magnetic developer containing a specific magnetic powder, a red azo pigment, different than the pigments of the present invention; and a binder resin, reference column 2, beginning at line 31. In U.S. Pat. No. 4,563,409 there are described positively charged toners obtained by mixing a coloring agent such as a dyestuff or pigment with a synthetic resin wherein the dyestuff apparently functions as a coloring agent, different than the pigments of the present invention; and an electric charge controlling material, see column 1, beginning at line 47. Other patents of background interest include U.S. Pat. Nos. 3,652,438; 3,781,208; 3,933,664; 4,051,052; 4,145,299; 4,414,320; 4,258,116; and 4,431,721.

Single component toners are disclosed in a number of publications. These toners are generally comprised of toner resin particles and magnetite. Also, recently there was developed an apparatus for charging toner particles comprised of a charging means, and a transporting means as illustrated in U.S. Pat. No. 4,459,009, the disclosure of which is totally incorporated herein by reference. Toners can be charged in this apparatus in a zone situated between the charging means, and transporting means. These toners are, however, charged negatively, or the charges thereon are of a rather low positive polarity thus rendering them unuseful in many situations. Therefore, there is a need for toners, especially colored toners which can be charged positively in the aforementioned apparatus. More specifically, there is a need for red toners that will charge to a positive polarity of a sufficient effective magnitude in the apparatus of the '363 patent. There is also a need for positively charged red toner compositions that are useful in electrostatic imaging processes wherein they enable images of excellent resolution with substantially no background deposits. Moreover, there is a need for positively charged red toner compositions that retain their triboelectric charge for an extensive period of time, which compositions are particularly useful for developing images generated on a layered photoconductive device charged negatively, such as the devices described in U.S. Pat. No. 4,265,990, the disclosure of which is totally incorporated herein by reference. There is also a need for single component red toners that can be charged to a sufficient specific positive polarity thereby minimizing background development which occurs with several prior art toner compositions wherein the positive charge is of a lower value. Thus, for example, when the positive charge is below about 10 microcoulombs per gram, there results with the developer selected subsequent to their utilization in an electrostatographic imaging apparatus, images with increased background deposits thereby undesirably permitting a reduction in image resolution. Additionally, there is a need for toner compositions wherein the positive charge is not significantly high, that is for example exceeding 30 microcoulombs per gram since in such instances the toner compositions cannot usually be efficiently transferred to the photoreceptor surface. There is also a need for single component red toners that can be effectively transferred to paper substrates from the photoreceptor subsequent to development thereby enabling images of acceptable optical densities. Thus, reflection optical densities of greater than 0.90 as measured on a Macbeth Densitometer with either yellow or green filters are obtainable with the developers of the present invention. Moreover, there is a need for toner compositions with melting characteristics to enable permanent fusing of the resulting toner to the image surface, and wherein such toner compositions do not agglomerate on standing. Both melting and blocking characteristics can generally be obtained with toner compositions comprised of resins that have glass transitions greater than about 50° C. but less than about 65° C.

SUMMARY OF THE INVENTION

It is an object of the present invention to provide colored toner compositions containing a charge enhancing additive which overcomes the above-noted disadvantages.

A further object of the present invention is to provide red toner compositions with charge enhancing additives therein.

Another object of the present invention is the provision of positively charged red toner compositions that are useful for the development of images in electrostatographic imaging processes.

In another object of the present invention there are provided red toner particles which can be charged to a positive polarity in an apparatus comprised of a charging means and a transporting means.

In yet a further object of the present invention there are provided red toner compositions which are water insensitive.

These and other objects of the present invention are accomplished by providing single component toner compositions comprised of resin particles and red pigment particles selected from the group consisting of substituted perylenes, and monoazo naphthol reds; charge enhancing components; and surface additive particles. In one embodiment of the present invention there are thus provided toner compositions comprised of resin particles, red pigment particles selected from the group consisting of substituted perylenes, Pigment Red 123, Pigment Red 149, Pigment Red 178, and Pigment Red 190; charge enhancing components selected from the group consisting of distearyl dimethyl ammonium methyl sulfate, and cetyl pyridinium chloride; and as additive silicas such as Aerosil.

In another specific embodiment of the present invention there are provided toner compositions comprised of resin particles blended with red pigment particles selected from the monoazo naphthol red group consisting of Pigment Red 17, Pigment Red 22, and Pigment Red 170; charge enhancing additives; and surface additives such as colloidal silicas.

Moreover, other red pigments that may be incorporated into the single component toner compositions of the present invention include Pigment Red 112, Red 4 and Pigment Red 46.

Illustrative examples of suitable toner resins selected for the toner compositions of the present invention include polyamides, epoxies, polyurethanes, polyolefins, vinyl resins, and polymeric esterification products of a dicarboxylic acid and a diol comprising a diphenol. Different suitable vinyl resins may be selected including homopolymers or copolymers of two or more vinyl monomers. Typical vinyl monomers are styrene, p-chlorostyrene vinyl naphthalene unsaturated mono-olefins such as ethylene, propylene, butylene, isobutylene and the like; vinyl halides such as vinyl chloride, vinyl bromide, vinyl fluoride, vinyl acetate, vinyl propionate, vinyl benzoate, vinyl butyrate and the like; vinyl esters such as esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate, and the like; acrylonitrile, methacrylonitrile, acrylamide, vinyl ethers, such as vinyl methyl ether, vinyl isobutyl ether, and vinyl ethyl ether; vinyl ketones such as vinyl methyl ketone, vinyl hexyl ketone, and methyl isopropenyl ketone; vinylidene halides such as vinylidene chloride, and vinylidene chlorofluoride; N-vinyl indole, and N-vinyl pyrrolidene; diolefins, such as styrene butadienes, available from Goodyear Chemical Company, especially styrene butadienes with about 90 percent by weight of styrene, and 10 percent by weight of butadiene, and mixtures thereof.

As one preferred toner resin there can be selected the esterification products of a dicarboxylic acid and a diol comprising a diphenol. These materials are illustrated in U.S. Pat. No. 3,655,374, the disclosure of which is totally incorporated herein by reference, the diphenol reactant being of the formula as shown in column 4, beginning at line 5 of this patent and the dicarboxylic acid being of the formula as shown in column 6. Other preferred toner resins include styrene/methacrylate copolymers, and styrene/butadiene copolymers. The resin is present in an amount in order that all of the ingredients incorporated into the toner composition total about 100 percent, thus when 5 percent by weight of charge enhancing component is used with 10 percent by weight of red pigment, and about 1 percent by weight of additive, about 85 percent by weight of resin material is selected.

Typical pigments that can be selected as the colorant for the toner particles include those embraced within the class of substituted perylenes, and naphthol reds, monoazo pigments inclusive of anthra[2,1,9-def:6,5,10-d'e'f']diisoquinoline-1,3,8,10(2H, 9H)-tetrone, 2,9-bis(4-ethoxyphenyl), Pigment Red 123, Cl 71145; 3,4,9,10-perylene tetra carboxylic acid condensed with p-phenyl azoaniline, Pigment Red 178, Cl 71155; Pigment Red 149; Pigment Red 190, Cl 71140; Pigment Red 224, Cl 71127; anthra[2,1,9-def:6,5,10-d'e'f']diisoquinoline-1,3,8,10(2H, 9H)tetrone, 2,9-dimethyl, Pigment Red 179, Cl 71130; Pigment Red 112, Cl 12370; 2-naphthalenol, 1-[2-chloro-4-nitrophenyl]azo, Pigment Red 4, Cl 12085; and Pigment Red 46. Preferred pigments that can be selected for the toner compositions of the present invention are Pigment Red 123, Red 149, and Red 112. These pigments are generally incorporated into the toner composition in an effective suitable amount provided the objectives of the present invention are achievable. More specifically, there can be selected from about 1 to about 15 percent by weight of the aforementioned pigments, and preferably from about 6 to about 10 percent by weight of these pigments.

As examples of those pigments which, when incorporated into a toner, either charge negatively or their positive charge is too low to be useful, there is mentioned laked azo pigments such as Pigment Red 48:2, Pigment Red 49:1, or Pigment Red 49:2. Thus, for example, toner compositions consisting of 90 parts Pliolite resin, 9.6 parts Pigment Red 48:2, 0.4 parts of dimethylquinacridone, and 2 parts of distearyldimethyl ammonium sulfate when tested in the developer apparatus of U.S. Pat. No. 4,459,009 resulted in prints of very low density and high background.

The charge on the toner was measured by placing a Faraday Cage against the donor roll and by applying a vacuum to the Faraday Cage, toner could be quantitatively removed from the donor roll over a prescribed area of 1 inch. The charge was then measured on a Kiethly Electrometer and the Faraday Cage weighted to determine, by difference, the weight of toner collected. Such measurements were repeated to obtain an average value of Q/M. Typically, such measurements were made with the donor roll biased at −100 volts for toners which charged positively, and at +100 volts for those toners which charged negatively.

Illustrative examples of charge enhancing additive components include distearyl dimethyl ammonium methyl sulfate described in U.S. Pat. No. 4,560,635, the disclosure of which is totally incorporated herein by reference; alkyl pyridinium halides, especially cetyl pyridinium chloride as described in U.S. Pat. No. 4,298,672, the disclosure of which is totally incorporated herein by reference; and organic sulfates, especially stearyl phenethyl dimethyl ammonium tosylate, reference U.S. Pat. No. 4,338,390, the disclosure of which is totally incorporated herein by reference.

Also, there can be added as color pigments, in addition to the red pigments disclosed hereinbefore, magenta, and/or yellow particles as well as mixtures thereof. Illustrative examples of magenta materials that may be selected as pigments include, for example, 2,9-dimethyl-substituted quinacridone and anthraquinone dye indentified in the color index as Cl 60710, Cl Dispersed Red 15, a diazo dye identified in the color index as Cl 26050, Cl Solvent Red 19, and Pigment Red 81:3, a Rhodamine siliconolybdic acid lake, and the like; while illustrative examples of yellow pigments that may be selected include diarylide yellow 3,3-dichlorobenzidene acetoacetanilides, a monoazo pigment identified in the color index as Cl 12700; Cl Solvent Yellow 16, a nitrophenyl amine sulfonamide identified in the color index as Foron Yellow SE/GLN; Cl Dispersed Yellow 33, 2,5-dimethoxy-4-sulfonanilide phenyl azo-4'-chloro-2,5-dimethoxy aceto-acetanilide; Permanent Yellow FGL; and the like. These pigments when utilized are generally present in an amount of from about 0.5 weight percent to about 5 weight percent based on the weight of the toner resin particles.

The single component toner compositions of the present invention may be selected for use in developing images in electrostatographic imaging systems containing therein conventional photoreceptors especially those that are capable of being charged negatively. This usually occurs with organic photoreceptors illustrative examples of which include layered photoresponsive devices comprised of transport layers and photogenerating layers, reference U.S. Pat. No. 4,225,990, the disclosure of which is totally incorporated herein by reference, and other similar layered photoresponsive devices. Examples of generating layers include trigonal selenium, metal phthalocyanines, metal free phthalocyanines and vanadyl phthalocyanines, while examples of the charge transport layers include the diamines as disclosed in U.S. Pat. No. '990. Other photoresponsive devices useful in the present invention include polyvinylcarbazole 4-dimethylaminobenzylidene, benzhydrazide; 2-benzylidene-amino-carbazole; (2-nitro-benzylidene)-p-bromoaniline; 2,4-diphenyl-quinazoline; 1,2,4-triazine; 1,5-diphenyl-3-methyl pyrazoline 2-(4'-dimethyl-amino phenyl)-benzoaxzole; 3-amino-carbazole, polyvinyl carbazole-trinitrofluorenone charge transfer complex; and mixtures thereof. Moreover, the toner compositions of the present invention are particularly useful for accomplishing the development of images in the apparatus as illustrated in U.S. Pat. No. 4,459,009, the disclosure of which is totally incorporated herein by reference. This apparatus enables a positive charge to be applied to the toner compositions of the present invention, while the incorporation of the charge enhancing additive permits the toner particles to be positively charged to a higher value. Thus, for example, these particles have a final positive charge thereon of from about 8 microcoulombs per gram to about 35 microcoulombs per gram, and preferably from about 10microcoulombs per gram to about 20 microcoulombs per gram. The aforementioned apparatus is comprised, for example, of a moving charge transporting means, with a triboelectrically active coating thereover, a moving transporting means, and a deflected flexible imaging member; and wherein a charging zone is situated between the charging means and the transporting means.

Also, there can be incorporated into the developer compositions of the present invention other additive particles such as low molecular weight wxes wherein the weight average molecular weight is less than 20,000, and preferably from about 1 to about 10,000, inclusive of polyethylenes and polypropylenes. These waxes are generally present in an amount of from about 1 percent by weight to about 10 percent by weight, and preferably in an amount of from about 2 to about 7 percent by weight. The examples of the aforementioned waxes are disclosed in U.S. Pat. No. 4,604,338, the disclosure of which is totally incorporated herein by reference.

The following examples are being supplied to further define various species of the present invention, it being noted that these examples are intended to illustrate and not limit the scope of the present invention. Parts and percentages are by weight unless otherwise indicated.

EXAMPLE I

There was prepared by melt blending, followed by mechanical attrition, a red toner composition, 11 microns average diameter, comprised of 88 percent by weight of a styrene butadiene resin with 89 percent by weight of styrene, and 11 percent by weight of butadiene, available from Goodyear Chemical Company as Pliolite; 10 percent by weight of Pigment Red 178, available from BASF as Paliogen Red K3911; and 2 percent by weight of the charge additive distearyl dimethyl ammonium methyl sulfate. Also, there was added to the aforementioned toner 0.5 percent by weight of Aerosil R972. This toner was then selected for the development of images in the electrostatic apparatus of the U.S. Pat. No. 4,459,009 patent, reference specifically the apparatus of FIG. 1 of this patent, and there resulted red images with acceptable resolution, and substantially no background deposits.

2.8 milligrams of the above prepared toner was removed from the donor roll of the apparatus of FIG. 1 of the U.S. Pat. No. 4,459,009 patent subsequent to development, and this sample was deposited in a Faraday Cage apparatus wherein the final toner charge was measured as being +17.1 microcoulombs per gram.

There was then prepared a toner composition by repeating the above procedure with the exception that this toner did not contain any charge enhancing additive, and further, there was selected 90 percent by weight of the styrene butadiene resin. A sample of this toner, 1.9 milligrams, had a triboelectric charge thereon of a −3.8 microcoulombs per gram after measurement in the Faraday Cage apparatus.

EXAMPLE II

There were prepared two other red toner compositions by repeating the procedure of Example I with the exception that there was selected 91.5 percent by weight of the Pliolite; 7 percent by weight of Pigment Red 149 in place of the 10 percent by weight of Pigment 178, or 7 percent by weight of Pigment Red 123; and 1.5 percent by weight of the charge additive. There resulted toners with a triboelectric charge of 21.5, and 17.3 microcoulombs per gram, respectively. Similar imaging results were obtained with these toners when they were selected for the imaging apparatus of Example I.

EXAMPLE III

There were prepared three different toner compositions by repeating the procedure of Example II with the exception that there was selected as red pigments 7 percent by weight of Pigment Red 22, 7 percent by weight of Pigment Red 17, and 7 percent by weight of Pigment Red 17, respectively. These toners, after charging in the apparatus of Example I, had triboelectric charges thereon of 18.7, 16.5, and 17.8, respectively.

EXAMPLE IV

There was prepared by melt blending, followed by mechanical attrition in accordance with the procedure as described in Example I, a red toner comprised of 90 percent by weight of Pliolite, 9.6 percent by weight of Pigment Red 48:2, a monazo calcium salt, and 0.4 percent of dimethyl quinacridone. This toner as determined in the Faraday Cage apparatus had a charge thereon of −7.6 microcoulombs per gram. Additionally, images of low resolution and substantial background deposits were obtained when this toner was incorporated into the imaging apparatus of FIG. 1 of the U.S. Pat. No. 4,459,009 patent, wherein the photoreceptor selected was charged positively.

EXAMPLE V

A toner composition was prepared by repeating the procedure of Example IV with the exception that there was selected 88 percent by weight of Pliolite, 9.6 percent by weight of Pigment Red 48:2, 0.4 percent by weight of dimethy quinacridone, and 2 percent by weight of distearyl dimethyl ammonium sulfate. This toner achieves a charge thereon of +1.2 microcoulombs per gram as determined by the Faraday Cage apparatus. When this toner composition was incorporated into the apparatus of FIG. 1 of the U.S. Pat. No. 4,459,009 patent containing a negatively charged, flexible imaging member, images of very low resolution with considerable background deposits were obtained because of the low positive charge on the toner particle.

EXAMPLE VI

A toner composition was prepared by repeating the procedure of Example I, which toner was comprised of 91.5 percent by weight of a styrene butadiene resin, 7 percent by weight of Pigment Red 149 (Paliogen Red K3580), available from BASF, and 1.5 percent by weight of distearyl dimethyl ammonium sulfate. There was then blended with the resulting toner composition 0.6 percent by weight of the silica powder, Aerosil S504-BT320, available from Degussa Chemical. This toner composition exhibited a charge thereon of +17.6 microcoulombs per gram as determined in the Faraday Cage apparatus.

EXAMPLE VII

A red toner composition was prepared by repeating the procedure of Example I, which toner contained 22 percent by weight of a styrene n-butylmethacrylate copolymer and divinyl benzene, 58 percent by weight of styrene, 42 percent by weight of n-butylmethacrylate, and 0.2 weight percent of divinyl benzene; 66 weight percent of a styrene butadiene Pliolite resin (89/11), 7 weight percent of Paliogen Red K3871 (PR123), and a low molecular weight polypropylene wax, available from Sanyo as 550-P wax, 3 percent by weight, and 2 percent by weight of distearyl dimethyl ammonium sulfate. This toner has a triboelectric charge thereon of +15.6 microcoulombs per gram as determined in the Faraday Cage apparatus as measured by removal of a sample of 2.6 milligrams of toner from the donor roll of the apparatus of FIG. 1 of the U.S. Pat. No. 4,459,009 patent. Additionally, this toner enabled images of excellent resolution with a flexible imaging member charged negatively in the apparatus of FIG. 1 of the U.S. Pat. No. 4,459,009 patent.

An additional toner composition was prepared by repeating the aforementioned procedure with the exception that there was further added to the toner composition 1 percent by weight of an amino silane treated silica 8504 VT302, and the charge on the toner particles was increased to 32.8 microcoulombs per gram.

The flexible imaging member selected for incorporation into the apparatus of the Examples was comprised of a Mylar substrate overcoated with a photogenerating layer of trigonal selenium dispersed in a polyvinyl carbazole binder, and as top layer in contact with the photogenerating layer, there was selected as charge transport molecules N,N'-diphenyl-N,N'-bis(3-methylphenyl)1,1'-biphenyl-4,4'-diamine, dispersed in a polycarbonate resin commercially available as Makralon, which member was prepared in accordance with the disclosure of U.S. Pat. No. 4,255,990.

Other modifications of the present invention may occur to those skilled in the art based upon a reading of the present disclosure and these modifications are intended to be included within the scope of the present invention.

What is claimed is:

1. A positively charged single component toner composition comprised of resin particles, pigment particles selected from the group consisting of substituted perylenes and monoazo pigments, and a charge enhancing additive.

2. A positively charged toner composition in accordance with claim 1 wherein the pigments are selected from the group consisting of Pigment Red 149, Pigment Red 190, and Pigment Red 224.

3. A toner composition in accordance with claim 1 wherein the charge enhancing additive is selected from the group consisting of alkyl pyridinium halides, organic sulfates, organic sulfonates, and distearyl dimethyl ammonium methyl sulfate.

4. A toner composition in accordance with claim 3 wherein the pigments are selected from the group consisting of Pigment Red 149, Pigment Red 190, and Pigment Red 224.

5. A toner composition in accordance with claim 1 wherein the resin particles are selected from styrene acrylates, styrene methacrylates, and styrene butadienes.

6. A toner composition in accordance with claim 1 further including therein or thereon additive particles.

7. A toner composition in accordance with claim 6 wherein the additive particles are comprised of colloidal silicas.

8. A toner composition in accordance with claim 1 wherein the pigments are selected from the group consisting of Pigment Red 17, Pigment Red 22, Pigment Red 170, and Pigment Red 112.

9. A toner composition in accordance with claim 1 wherein the resin particles are selected from a group consisting of styrene acrylates, styrene methacrylates, and styrene butadienes.

10. A toner composition in accordance with claim 1 wherein the charge enhancing additive is selected from the group consisting of alkyl pyridinium halides, distearyl dimethyl ammonium methyl sulfate, and stearyl phenethyl dimethyl ammonium tosylate.

11. A toner composition in accordance with claim 1 wherein the charge thereon is from about 15 microcoulombs per gram to about 35 microcoulombs per gram.

12. A toner composition in accordance with claim 1 further including therein a wax with a molecular weight of from about 1,000 to about 6,000.

13. A toner composition in accordance with claim 12 wherein the wax is selected from the group consisting of polyethylene, polypropylene, or poly(ethylene-co-propylene).

14. A toner composition in accordance with claim 1 wherein the pigment is 2-naphthalenol, 1-[2-chloro-4-nitrophenyl]azo.

15. A toner composition in accordance with claim 1 wherein the pigment is anthra[2,1,9-def:6,5,10-d'e'f']diisoquinoline-1,3,8,10(2H, 9H)-tetrone, 2,9-bis(4-ethoxyphenyl).

16. A toner composition in accordance with claim 1 wherein the red pigment is anthra[2,1,9-def:6,5,10-d'e'f']diisoquinoline-1,3,8,10(2H, 9H)-tetrone, 2,9-dimethyl.

17. A toner composition in accordance with claim 1 wherein the red pigment is 3,4,9,10-perylene tetra carboxylic acid condensed with p-phenylazoaniline.

* * * * *